US005474017A

United States Patent [19]

Mohebbi et al.

[11] Patent Number: 5,474,017

[45] Date of Patent: Dec. 12, 1995

[54] PARKING SPACE HOLDER

[76] Inventors: Habib Mohebbi, 3648 Calvin Ave., San Jose, Calif. 95124; Hamid Dadashzadeh, 756 Bounty Dr., #5608, Foster City, Calif. 94404

[21] Appl. No.: 366,995

[22] Filed: Dec. 30, 1994

[51] Int. Cl.[6] ..... E01F 9/10; E05B 65/00; E05B 11/00

[52] U.S. Cl. ..... 116/209; 116/28 R; 116/63 R; 49/35; 49/131

[58] Field of Search ..... 116/28 R, 30, 116/33, 63 R, 63 P, 63 T, 209, 306, 307, DIG. 15, DIG. 16; 404/6, 11; 40/610, 612; 403/109; 49/35, 49, 131, 132, 133, 134

[56] References Cited

U.S. PATENT DOCUMENTS

| | | | |
|---|---|---|---|
| 1,164,909 | 12/1915 | Auberlin | 116/63 R |
| 3,564,769 | 2/1971 | Wilson et al. | 49/131 |
| 4,003,161 | 1/1977 | Collins | 49/131 |
| 4,576,508 | 3/1986 | Dickinson | 49/131 |
| 4,715,742 | 12/1987 | Dickinson | 49/49 |
| 5,192,159 | 3/1993 | Higginson | 49/131 |
| 5,365,694 | 11/1994 | Macaluso | 49/131 |

FOREIGN PATENT DOCUMENTS

| | | | |
|---|---|---|---|
| 2686355 | 7/1993 | France | 49/131 |
| 2686633 | 7/1993 | France | 49/131 |

*Primary Examiner*—William A. Cuchlinski, Jr.
*Assistant Examiner*—Andrew Hirshfeld
*Attorney, Agent, or Firm*—Keith Kline

[57] ABSTRACT

A parking space holder including a plurality of telescoping sections that can be locked in an upright, extended position to block an entrance to a parking area or space. When unlocked, the space holder can be collapsed to a position generally flush with the parking surface to allow passage of a car. The user may use any number of the devices to designate a parking area.

4 Claims, 3 Drawing Sheets

PARKING SPACE HOLDER

FIELD OF THE INVENTION

The present invention relates generally to parking space designation devices, and more particularly is a collapsible barrier to reserve a parking space.

BACKGROUND OF THE INVENTION

There are various current art methods used to designate reserved parking spaces. The most common techniques are painting reserving signs either on a wall of an adjacent building, or on the surface of the parking space itself.

The obvious limitations to these methods are if there is no cooperative building in an appropriate position, or if a potential unauthorized user does not see or simply ignores a space designation.

Another method of assuring that a space is available is to physically block the space. This is generally done by simply placing an obstacle in the space, such as a barrel or a post. However, depending on the installation, these barriers can be moved by determined violators. Making the barriers immovable, such as by locking them down, makes them difficult to deploy. Theses types of barriers also generally require significant storage space as well.

OBJECTS, SUMMARY, AND ADVANTAGES OF THE INVENTION

Accordingly, it is an object of the present invention to provide a means to designate a parking space.

It is another object of the present invention to provide a device that cannot be easily removed by an unauthorized person so that a vehicle parked in the designated space is secure.

In summary, the present invention is a parking space holder. It comprises a plurality of telescoping sections that can be locked in an upright, extended position to block an entrance to a parking area or space. When unlocked, the space holder can be collapsed to a position flush with the parking surface to allow passage of a car. The user may use any number of the devices to designate a parking or display area.

An advantage of the present invention is that it physically blocks the entrance to a parking space.

Another advantage of the present invention is that it can be collapsed to a position that is flush with the parking surface, thereby requiring no storage space.

A still further advantage of the present invention is that it provides security for a car parked in a space blocked by the device.

Another advantage of the present invention is that it may be constructed to any size desired by the user.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
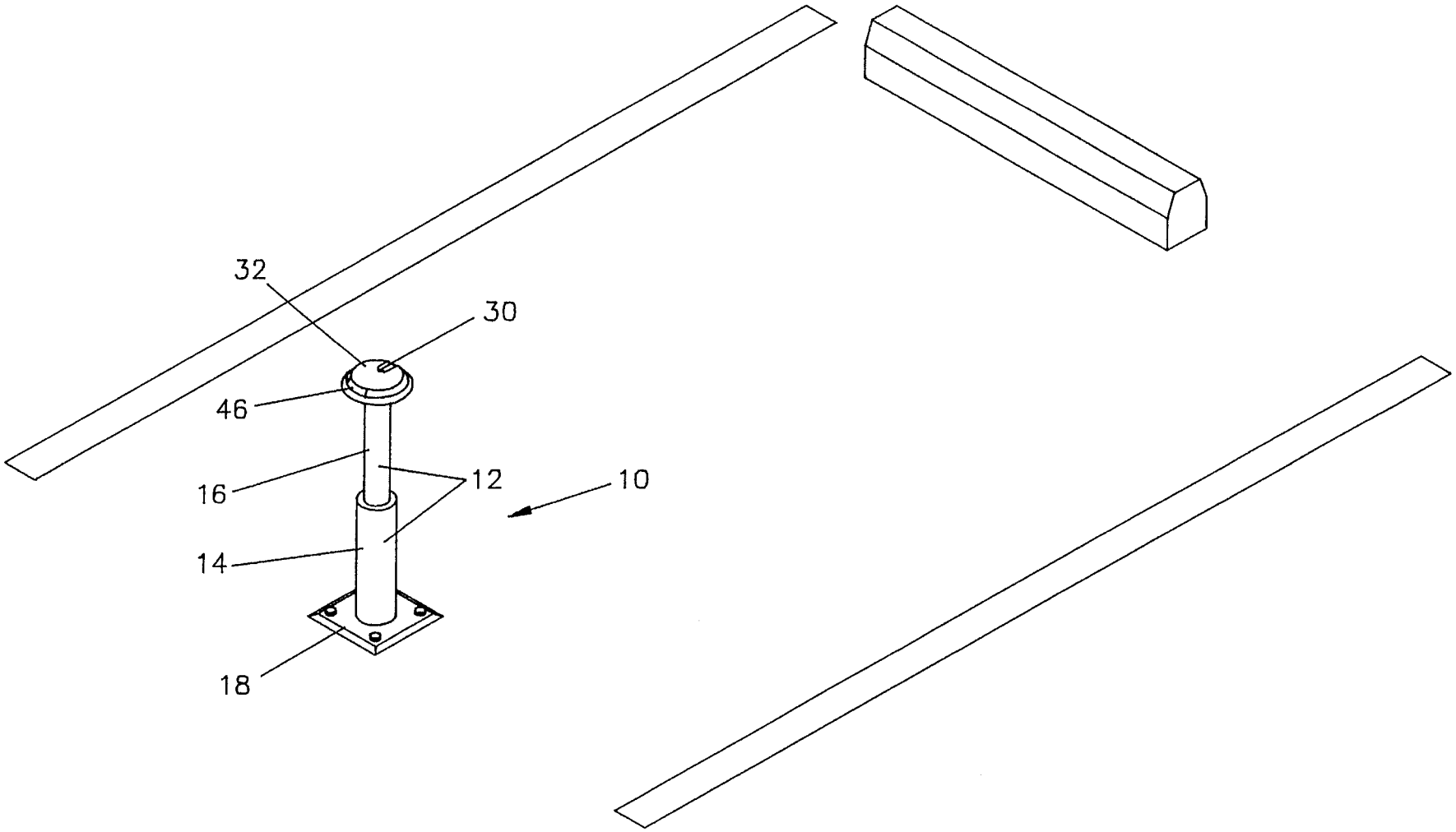
FIG. 1 is a perspective view of the parking space holder of the present invention installed in a parking lot.

The present invention is a parking space holder 10. The device is constructed from multiple telescoping sections 12. While any shape and number of sections 12 can be utilized, it is envisioned that in the preferred embodiment, the sections 12 will most often be cylindrical, and will be two in number. It is also envisioned that the sections 16 will often be polygonal. The sections 12 are each closed at a lower end. The preferred embodiment of the sections 12 includes a lowermost section 14 and an upper section 16.

A mounting fixture 18 is installed in a parking surface so that a top edge of the mounting fixture 18 is generally flush with the top of the parking surface. A hole must be cut into the parking surface of sufficient size to receive the parking space holder 10 when it is collapsed. A sleeve 19 may be inserted into the hole if desired by the user, and may be required depending on the composition of the parking surface.

The sections 12 are fixed in place when the space holder 10 is extended by a locking rod 20. The locking rod 20 is also constructed from telescoping segments to mirror the construction of the sections 12. The locking rod 20 passes through openings in the lower ends of the sections 12.

In the preferred embodiment, the locking rod 20 is formed from square hollow tubing. The sizes of the segments of the locking rod 20 are chosen so that they nest together when the space holder 10 is collapsed.

The number of segments of the locking rod 20 will usually be equal to the numbers of sections 12. In the preferred embodiment, there will be at least a lower segment 22 and an upper segment 24 of the locking rod 20. Each segment of the locking rod 20 includes near a lower end a locking tab 26. Gaskets 27 ensure a snug fit between the sections 12 so that slippage does not occur.

A key lock 30 is inserted into a cap plate 32 at an upper end of the device. The key lock 30 must be activated to allow rotation of the locking rod 20.

In order to inhibit the free rotation of the device and to provide additional stability when the device is extended, a fixing rod 34 is installed in a base 36 of the lower section 14. The fixing rod 34 has a polygonal cross section, so that it cannot rotate within a similarly shaped receiving socket 38 which is installed in a base of the upper section 16. So that the holder 10 may be collapsed and extended, the fixing rod 34 includes a plurality of telescoping members including an upper telescoping member 21, an interior telescoping member 23, and a lower telescoping member 25.

Figure 2:
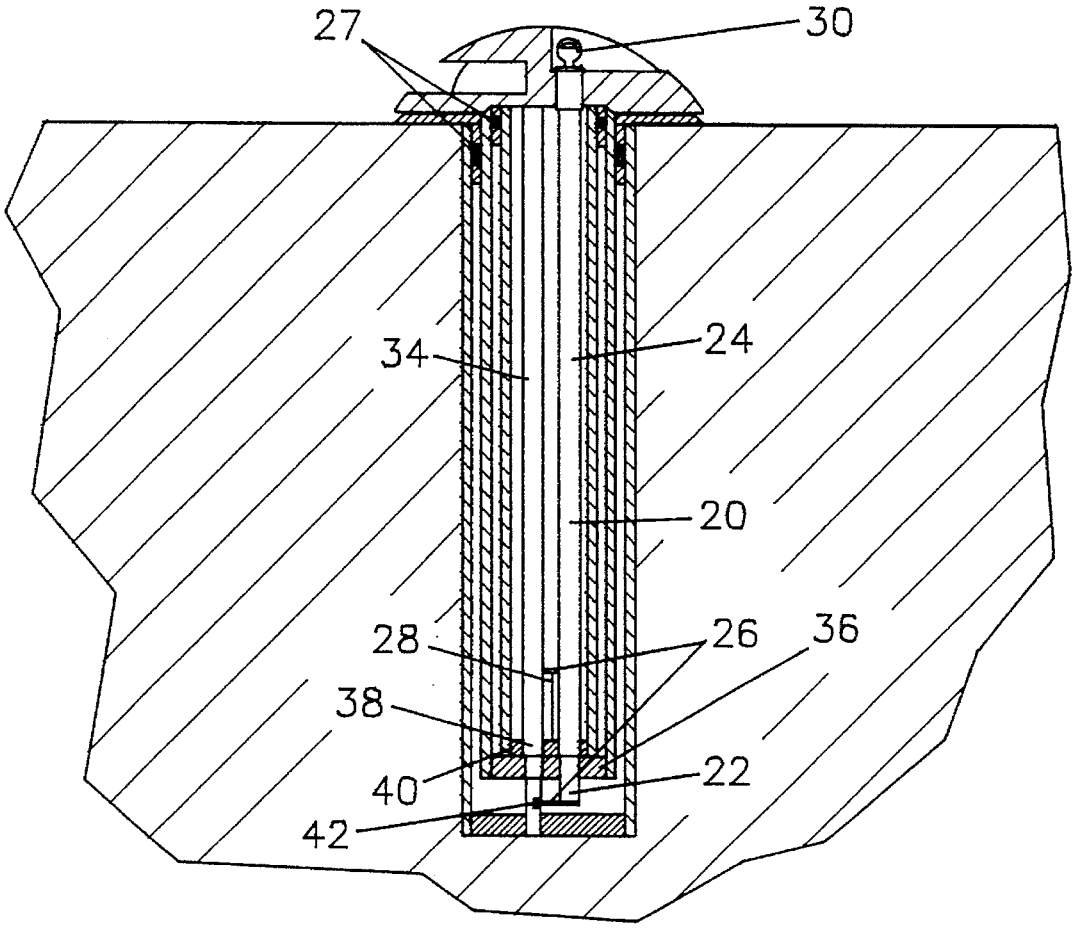
FIG. 2 is a cross section view of the parking space holder in the collapsed position.

Near a lower end of the fixing rod 34 is a lower receiving notch 42 which is utilized to lock the space holder 10 in its collapsed position. To place the holder 10 in the collapsed position, the locking rod is rotated so that the lowermost locking tab 26 is received in the notch 42 which is shown in FIG. 2. Also shown in FIG. 2 is a stop member 28 which protrudes from the upper telescoping member 21 to provide a bearing surface for the locking tab 26 of the upper segment 24.

Operation of the parking space holder from the collapsed position is as follows:

A user inserts his key into the key lock 30, rotating the locking rod 20 so that the locking tab 26 in the lower segment 22 rotates out of the notch 42 in the fixing rod 34 and the locking tab 26 of the upper segment 24 rotates out of engagement with the stop 28.

Figure 3:
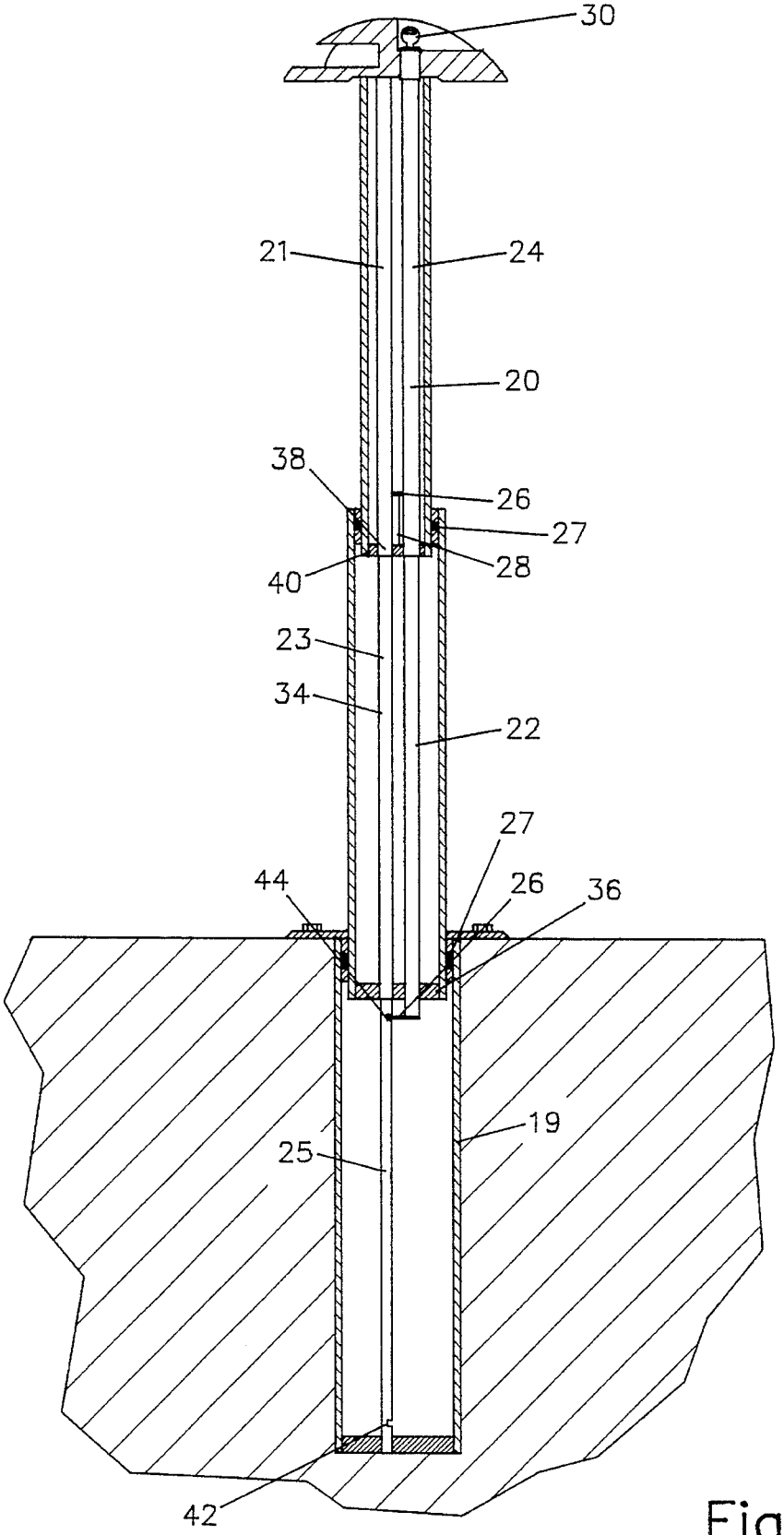
FIG. 3 is a cross section view of the parking space holder in the extended position.

The user then lifts the device by a handle 46 in the cap plate 32. When the device is fully extended, the locking rod 20 is rotated so that the lower locking tab 26 is received in the upper receiving notch 44, and the upper locking tab 26 rests on the stop 28 on the fixing rod 34. The key is then removed, and the holder 10 is fixed in its extended position, as shown in FIG. 3.

To lower the holder 10, the process is reversed. The user inserts the key into the key lock 30 to rotate the locking rod 20. The locking rod 20 is rotated until the locking tabs 26 are disengaged from the fixing rod 34. The upper section 16 can then be lowered into the lower section 14, which in turn is lowered beneath the parking surface until the cap plate 32 rests directly on the parking surface.

The locking rod 20 is again rotated until the lower locking tab 26 on the lower segment 22 is received in the receiving notch 42 of the fixing rod 34. The user removes the key, and the parking space holder 10 is locked in its collapsed position.

It is envisioned that a user will use the upper surface of the cap plate as a handy spot to apply identifying information, personalization, or advertising material. It is further envisioned that a user may group multiples of the space holders together, by connecting them with a rope or a chain, to designate large blocks of parking areas.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

We claim:

1. A parking space holder comprising:

a plurality of tubular telescoping sections each having a base portion, said plurality of telescoping sections including an upper telescoping section and a lowermost telescoping section, said upper telescoping section capable of telescoping over said lowermost telescoping section, a locking rod comprising a plurality of locking rod telescoping segments, the number of locking rod telescoping segments being equal to the number of tubular telescoping sections, one segment of the locking rod telescoping segments having a locking tab thereon, said locking rod being rotatable with respect to said tubular telescoping sections, a fixing rod having a plurality of telescoping members including an upper telescoping member, an interior telescoping member, and a lower telescoping member, the interior telescoping member being secured within the base portion of the lowermost telescoping section, the upper telescoping member being secured within the base portion of the upper telescoping section, said fixing rod having a polygonal cross section so as to inhibit rotation of the upper telescoping section relative to the lowermost telescoping section, said lower telescoping member having an upper receiving notch and a lower receiving notch, said tubular telescoping sections being maneuverable into a collapsed position wherein said locking tab is maneuverable into said lower receiving notch by said rotation of said locking rod, said tubular telescoping sections also being maneuverable to an extended position wherein said locking tab is maneuverable into said upper receiving notch by said rotation of said locking rod, movement of said tubular telescoping sections between said extended position and said collapsed position being when said locking tab is not received within said lower receiving notch and is also not received within said upper receiving notch, a cap plate affixed to a top end of the upper telescoping section, and a mounting fixture secured in a hole in a parking surface, said space holder being mounted in said mounted fixture wherein only said cap plate is exposed when said plurality of tubular sections is in said collapsed position.

2. The parking space holder of claim 1 wherein:

the number of telescoping sections is two.

3. The parking space holder of claim 1 wherein:

the tubular telescoping sections are round in cross section.

4. The parking space holder of claim 1 wherein:

the tubular telescoping sections are polygonal in cross section.

* * * * *